US010644438B2

(12) United States Patent
Li et al.

(10) Patent No.: US 10,644,438 B2
(45) Date of Patent: May 5, 2020

(54) POWER PLUG WITH LEAKAGE CURRENT PROTECTION DEVICE

(71) Applicant: Chengli Li, Suzhou (CN)

(72) Inventors: Chengli Li, Suzhou (CN); Shengyun Nie, Suzhou (CN)

(73) Assignee: Chengli Li, Suzhou (CN)

( * ) Notice: Subject to any disclaimer, the term of this patent is extended or adjusted under 35 U.S.C. 154(b) by 85 days.

(21) Appl. No.: 15/847,896

(22) Filed: Dec. 19, 2017

(65) Prior Publication Data

US 2018/0331465 A1 Nov. 15, 2018

Related U.S. Application Data

(63) Continuation-in-part of application No. 15/592,674, filed on May 11, 2017, now Pat. No. 10,170,265.

(30) Foreign Application Priority Data

Dec. 8, 2017 (CN) ..... 2017 1 1294238
Dec. 8, 2017 (CN) ..... 2017 2 1700251 U

(51) Int. Cl.
*H01H 83/06* (2006.01)
*H01R 13/533* (2006.01)
(Continued)

(52) U.S. Cl.
CPC ..... *H01R 13/533* (2013.01); *H01R 11/07* (2013.01); *H01R 13/6275* (2013.01);
(Continued)

(58) Field of Classification Search
CPC ..... H01R 13/5816; H01R 13/506; H01R 13/631; H01R 13/16; H01R 13/533;
(Continued)

(56) References Cited

U.S. PATENT DOCUMENTS 3,761,774 A 9/1973 Laughinghouse et al.
4,001,647 A 1/1977 Klein et al.
(Continued)

FOREIGN PATENT DOCUMENTS

CA 2512785 A1 9/2006
WO 2010/135904 A1 12/2010

*Primary Examiner* — Shawki S Ismail
*Assistant Examiner* — Lisa N Homza
(74) *Attorney, Agent, or Firm* — Chen Yoshimura LLP

(57) ABSTRACT

A power plug with leakage current protection device, which includes a body formed of an upper cover and a base, a core assembly disposed in the body, a cable assembly attached to the body, a plurality of input insertion plates and output moving contact arms which are assembled with the core assembly, and an insertion plate sleeve disposed on the base, where the input insertion plates pass through the insertion plate sleeve to protrude from the base. The insertion plate sleeve is made of an insulating and temperature resistant material. The power plug has a simple overall structure and can be assembled easily and reliably. It can prevent the safety risk caused by high temperature of the input insertion plates without increasing the size of the plug. It also has low cost, and can be suitably employed in various types of power plugs.

8 Claims, 4 Drawing Sheets

(51) Int. Cl.

| | |
|---|---|
| ***H01R 13/627*** | (2006.01) |
| ***H01R 13/629*** | (2006.01) |
| ***H01R 11/07*** | (2006.01) |
| ***H01R 13/713*** | (2006.01) |
| *H01R 24/28* | (2011.01) |
| *H01R 13/512* | (2006.01) |

(52) U.S. Cl.
CPC ... *H01R 13/62916* (2013.01); *H01R 13/7135* (2013.01); *H01R 13/512* (2013.01); *H01R 24/28* (2013.01)

(58) Field of Classification Search
CPC ..... H01R 13/6275; H01R 13/62916; H02H 1/0007; H02H 11/0007; H02H 11/07; H02H 71/10; H02H 71/04; H02H 71/08; H02H 71/0264
USPC ..... 335/18
See application file for complete search history.

(56) References Cited

U.S. PATENT DOCUMENTS

| | | | | |
|---|---|---|---|---|
| 4,001,652 | A | 1/1977 | Klein et al. | |
| 4,010,432 | A | 3/1977 | Klein et al. | |
| D270,628 | S * | 9/1983 | Bobrovniczky | D13/138.2 |
| 4,409,574 | A | 10/1983 | Misencik et al. | |
| 5,394,289 | A | 2/1995 | Yao et al. | |
| 5,661,623 | A * | 8/1997 | McDonald | H01H 83/02 361/42 |
| 5,862,029 | A * | 1/1999 | Nicol | H01H 83/02 361/115 |
| D434,010 | S * | 11/2000 | Stekelenburg | D13/160 |
| D451,481 | S * | 12/2001 | MacKay | D13/160 |
| D473,188 | S * | 4/2003 | Cheah | D13/138.2 |
| D511,468 | S * | 11/2005 | Aromin | D10/78 |
| D511,469 | S * | 11/2005 | Aromin | D10/78 |
| D562,766 | S * | 2/2008 | Yang | D13/110 |
| 7,414,499 | B2 | 8/2008 | Germain | |
| D579,881 | S * | 11/2008 | Aromin | D13/160 |
| 7,621,765 | B1 * | 11/2009 | Wu | H01R 31/06 439/173 |
| 7,753,721 | B1 * | 7/2010 | Wu | H01R 13/6275 431/131 |
| D633,869 | S * | 3/2011 | Aromin | D13/138.1 |
| D635,937 | S * | 4/2011 | Aromin | D13/138.1 |
| 8,390,404 | B2 * | 3/2013 | Zou | H01R 13/7135 335/18 |
| 8,824,110 | B2 * | 9/2014 | Zou | H02H 3/06 361/42 |
| D727,185 | S * | 4/2015 | Aromin | D10/78 |
| 9,036,320 | B1 | 5/2015 | Elberbaum | |
| D742,831 | S * | 11/2015 | Yu | D13/139.6 |
| 9,713,273 | B2 | 7/2017 | Li et al. | |
| 9,825,415 | B1 * | 11/2017 | Lin | H01R 31/06 |
| 9,876,345 | B2 | 1/2018 | Weeks et al. | |
| 2002/0003686 | A1 * | 1/2002 | Disalvo | H01H 83/04 361/42 |
| 2002/0154488 | A1 | 10/2002 | Leopold et al. | |
| 2003/0016477 | A1 | 1/2003 | Li | |
| 2004/0027740 | A1 | 2/2004 | Huang et al. | |
| 2006/0061924 | A1 * | 3/2006 | Zhang | H01R 13/652 361/42 |
| 2007/0279162 | A1 | 12/2007 | Zhang et al. | |
| 2008/0094764 | A1 * | 4/2008 | Zhang | H01R 13/665 361/42 |
| 2008/0135274 | A1 * | 6/2008 | Peck | H01R 13/502 174/58 |
| 2009/0184787 | A1 | 7/2009 | Weeks et al. | |
| 2010/0046128 | A1 | 2/2010 | Wang et al. | |
| 2012/0147570 | A1 | 6/2012 | Yamazaki | |
| 2013/0100560 | A1 | 4/2013 | Zou | |
| 2013/0277086 | A1 * | 10/2013 | Rohmer | H05K 5/02 174/51 |
| 2014/0139955 | A1 | 5/2014 | Ye et al. | |
| 2014/0140010 | A1 | 5/2014 | Chan et al. | |
| 2014/0177169 | A1 | 6/2014 | Restrepo et al. | |
| 2014/0192492 | A1 | 7/2014 | Wojcik et al. | |
| 2014/0364014 | A1 * | 12/2014 | Kawamoto | H01R 13/424 439/692 |
| 2015/0116872 | A1 * | 4/2015 | Li | H02H 1/0015 361/42 |
| 2015/0200533 | A1 | 7/2015 | Simonin | |
| 2015/0327380 | A1 * | 11/2015 | Li et al. | H02H 9/005 361/118 |
| 2017/0244206 | A1 * | 8/2017 | Jiang | H01R 13/5219 |
| 2017/0244237 | A1 | 8/2017 | Weeks et al. | |
| 2018/0145500 | A1 | 5/2018 | Weeks et al. | |
| 2018/0166242 | A1 * | 6/2018 | Li | H01H 71/0264 |
| 2018/0166833 | A1 * | 6/2018 | Nie | H01H 73/44 |
| 2019/0199047 | A1 * | 6/2019 | Zhang | H01R 31/06 |

* cited by examiner

POWER PLUG WITH LEAKAGE CURRENT PROTECTION DEVICE

BACKGROUND OF THE INVENTION

Field of the Invention

This invention relates to electrical appliances, and in particular, it relates to a power plug for electrical appliances that incorporates a leakage current protection device.

Description of Related Art

With the wide use of home electrical appliances, their safety is an important issue. Current electrical appliances typically have a power plug that incorporates a leakage current protection device. However, current power plugs with leakage current protection devices still have certain problems affecting their safety. For example, when the insertion plates of the power plug have a bad connection, or when the spring force that maintains the tight contact between the insertion plates and the conductors of the power receptacle deteriorate due to long-time use, the electrical resistance associated with the insertion plates may increase. This can cause the temperature of the insertion plates to increase, which can deform the plastic body of the plug near the insertion plates, or even cause fire. This can be a serious safety threat.

SUMMARY

To solve the above described problem, embodiments of the present invention provides an improved power plug with leakage current protection device, which is equipped with a protection piece made of an insulating material with high temperature resistance, located near where the insertion plates are connected to the body of the power plug. This can prevent the plug body from melting due to the high temperature of the insertion plates, and ensure the normal operation of the plug.

In one embodiment, the present invention provides a power plug with leakage current protection device, which includes: a body formed of an upper cover and a base; a core assembly disposed in the body; a cable assembly attached to the body; a plurality of input insertion plates; a plurality of output moving contact arms; wherein the plurality of input insertion plates and the plurality of output moving contact arms are assembled with the core assembly; and an insertion plate sleeve disposed on the base, wherein the input insertion plates pass through the insertion plate sleeve to protrude from the base, and wherein the insertion plate sleeve is made of an insulating and temperature resistant material.

The invention includes the following preferred embodiments.

In some embodiments, the insertion plate sleeve includes a number of parts corresponding to a number of the input insertion plates, wherein each part includes a hole for accommodating one input insertion plate that passes through the hole, and wherein the insertion plate sleeve further includes an assembly base which is connected to the base of the body.

In some embodiments, the hole of each of the parts is a sleeve that protrudes upwards from a bottom of the assembly base.

In some embodiments, the insertion plate sleeve is formed integrally as one piece.

In some embodiments, the base of the body defines an opening, and wherein the insertion plate sleeve is disposed in the opening and the assembly base of the insertion plate sleeve is connected to the base of the body via snaps.

In some embodiments, the insertion plate sleeve is formed of engineering plastics, ceramics, or fiber glass.

In some embodiments, the insertion plate sleeve includes a number of parts corresponding to a number of the input insertion plates, the number of parts being separate from each other, wherein each part includes an assembly base which is connected to the base of the body and a hole for accommodating one input insertion plate that passes through the hole.

In some embodiments, the hole of each of the parts is a sleeve that protrudes upwards from a bottom of the corresponding assembly base.

In some embodiments, the base of the body defines a number of openings corresponding to the number of the input insertion plates, and wherein each of the separate parts is disposed in a corresponding opening and the assembly base of the part is connected to the base of the body via snaps.

The power plug with leakage current projection device according to embodiments of the present invention can effectively prevent safety risk caused by high temperature of the insertion plates, is reliable, has a simple structure, and is easy to implement. Compared to a design that uses an insulating material for the entire plug body, the power plug according to embodiments of the present invention is more cost effective.

BRIEF DESCRIPTION OF THE DRAWINGS

Other characteristics and advantages of the present invention are described in various embodiments with reference to the following drawings.

DETAILED DESCRIPTION OF PREFERRED EMBODIMENTS

Embodiments of the present invention and their operation are described in detail below. It should be understood that the embodiments described here serve to illustrate the implementations and operation of the invention, and do not limit the scope of the invention. The directional expressions such as up, down, top, bottom, etc. that are used in the descriptions are relative and not absolute. When the various components are disposed in the illustrated manner, these directional expressions are appropriate; when the arrangements of the components change, the directional expressions may change accordingly.

Figure 1:
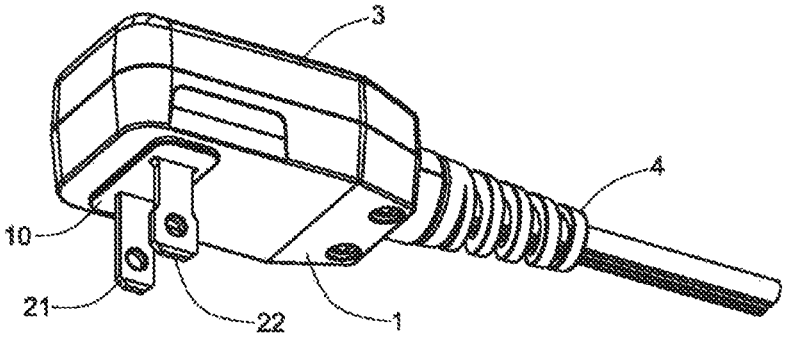
FIG. 1 is an exterior view of a power plug with leakage current protection device according to an embodiment of the present invention.
Figure 2:
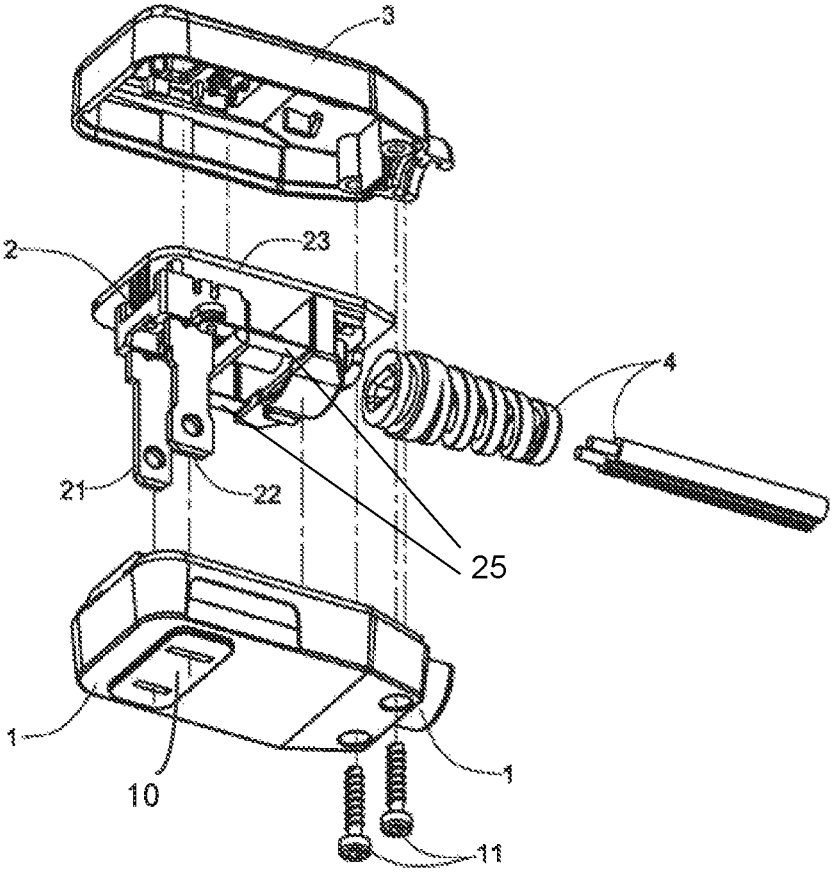
FIG. 2 is an exploded view of the power plug of FIG. 1, viewed from the bottom, where an insertion plate sleeve is connected to the base.
Figure 3:
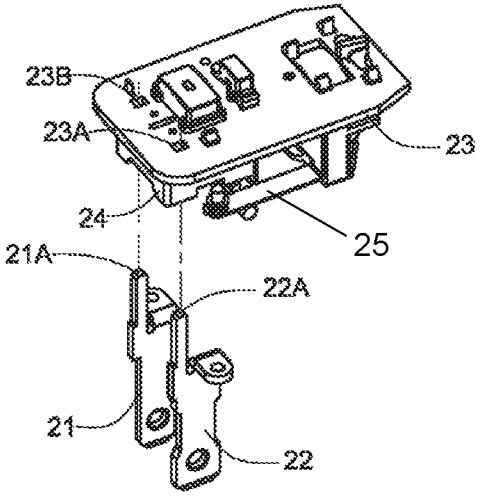
FIG. 3 is an exploded view showing the core assembly and the input insertion plates.
Figure 4:
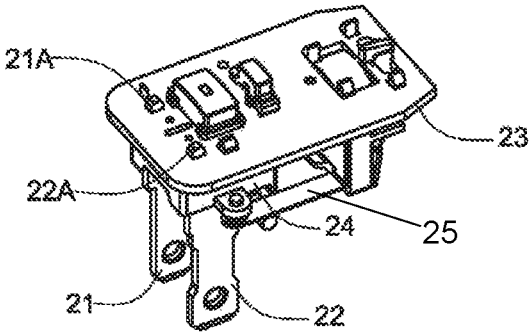
FIG. 4 is an assembled view showing the core assembly and the input insertion plates.
Figure 5:
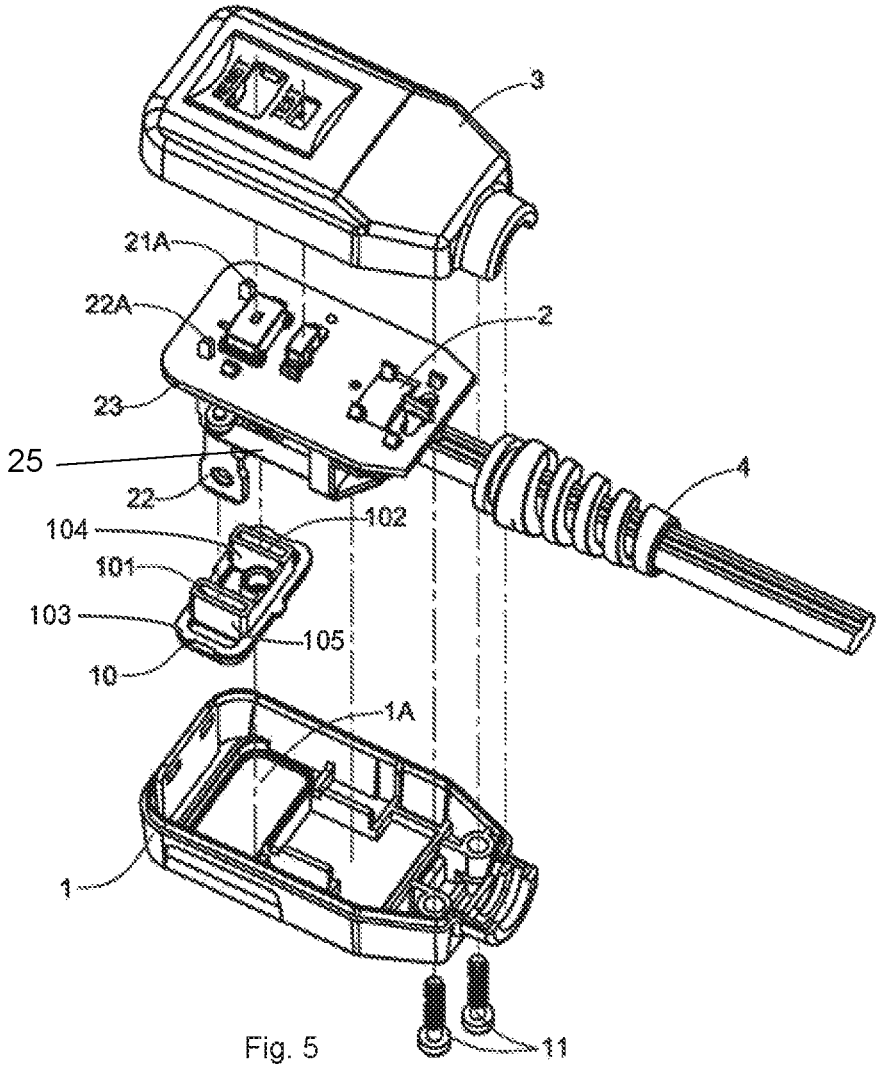
FIG. 5 is an exploded view of the power plug of FIG. 1, viewed from the top, showing the insertion plate sleeve separated from the other components.
Figure 6:
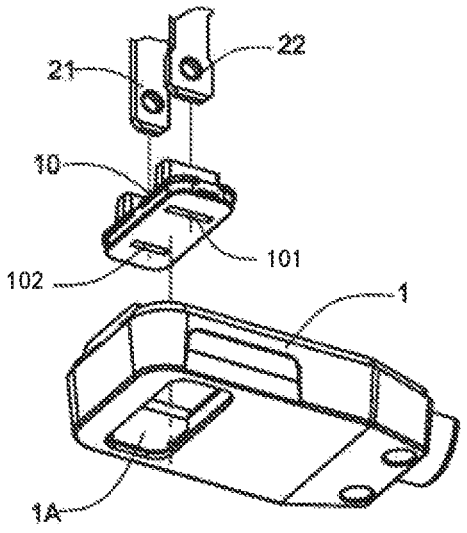
FIG. 6 is an exploded view of a portion of the power plug of FIG. 5, viewed from the bottom.

Refer to FIGS. 1-6, which illustrate a power plug with leakage current protection device according to a preferred embodiment of the present invention. The power plug includes a body formed by an upper cover 3 and a base 1. A core assembly 2 and a cable assembly 4 are disposed in the body. The core assembly 2 includes a printed circuit board 23 and a detection assembly and a trip assembly disposed on the printed circuit board 23. Input insertion plates 21, 22 and output moving contact arms 25 are respectively assembled with the core assembly 2. As shown in FIGS. 3 and 4, the input insertion plates 21, 22 are supported by and fixed on an insertion plate support frame 24, and the soldering ends 21A, 22A of the input insertion plates 21, 22 pass through solder plate holes 23B, 23A of the printed circuit board 23 and soldered on the printed circuit board 23, to establish reliable electrical connection. The cable assembly 4 includes an electrical cable and a cable release that covers the cable. The cable release is fixed by a slot formed on the upper cover 3 and the base 1, to provide bending resistance for the cable. Further, a reset button and a test button are disposed between the upper cover 3 and the core assembly 2. After the various components inside the body are assembled, the upper cover 3 and the base 1 are aligned to each other via snaps on these two components, and fastened together using fastening components such as screws.

According to embodiments of the present invention, the power plug further includes an insertion plate sleeve disposed on the base 1, such that the input insertion plates pass through the insertion plate sleeve to protrude from the base. The insertion plate sleeve is made of an insulating and high temperature resistant material, for example, materials that will not deform or melt at temperatures from about 110 degrees C. to hundreds of degrees C. In comparison, the body (base and upper cover) is made of a lower cost plastic material that may start to deform or melt at temperatures below about 110 degrees C. Advantageously, the insertion plate sleeve includes a number of parts corresponding to the number of the input insertion plates. For example, in the embodiment shown in FIGS. 5 and 6, the insertion plate sleeve 10 includes two parts 101 and 102 which are formed integrally as one piece, and the parts 101, 102 respectively correspond to the two input insertion plates 21, 22. More specifically, the insertion plate sleeve 10 includes an assembly base 103 formed around the bottom of the parts 101, 102, and holes 104, 105 for respectively accommodating the input insertion plates 21, 22 that pass through them. The assembly base 103 has a connection structure such as hooks and/or snaps, which engages a corresponding connection structure such as snaps and/or hooks located around an opening 1A of the base 1. It should be understood that the number of hooks or snaps on the assembly base and the base may be one or more. These connection structures can ensure high assembly quality and reduce assembling time.

In this embodiment, the holes 104, 105 of parts 101, 102 can be formed by sleeves that protrude upwards from the bottom of the assembly base, which can precisely position and securely hold the input ends of the input insertion plates 21, 22. In particular, the sleeves can extend to the base of the input insertion plates 21, 22 close to the insertion plate support frame 24. This can prevent the risk caused by high temperature of the input insertion plates. It should be understood that holes of other shapes may also be used.

Figure 7:
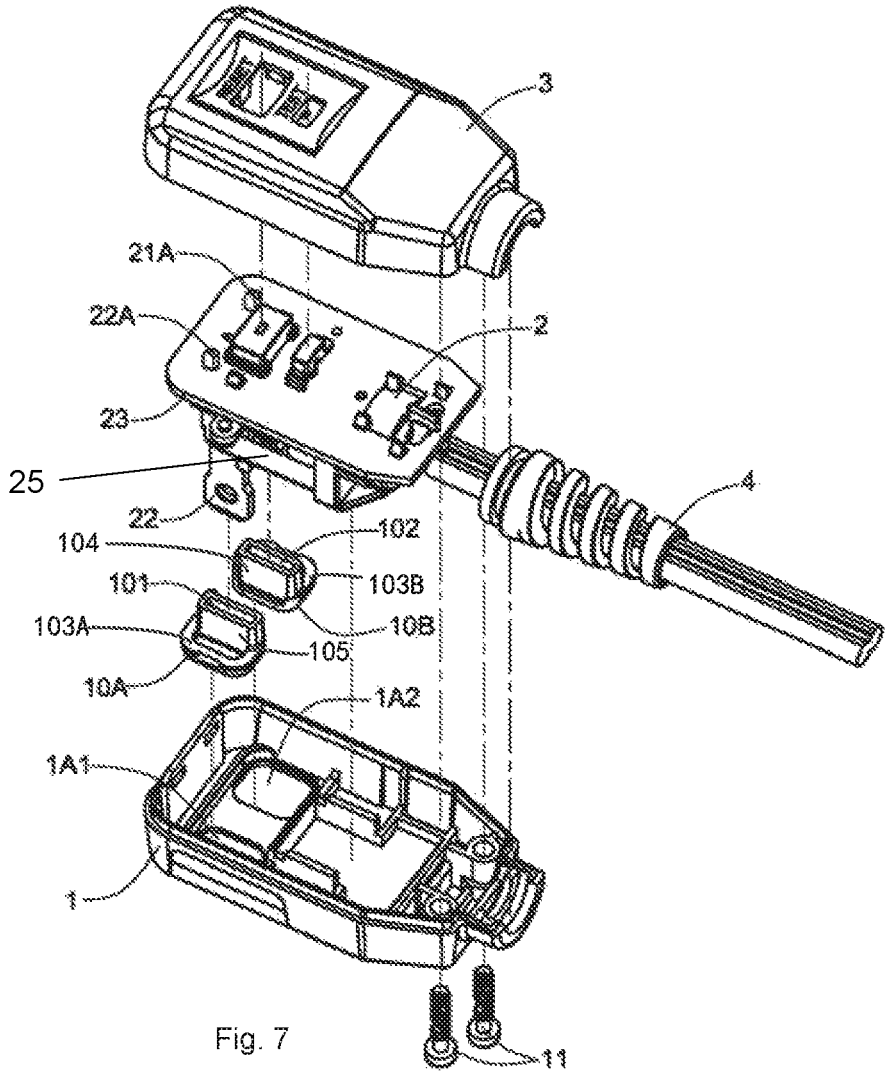
FIG. 7 is an exploded view of a power plug according to another embodiment, in a view similar to FIG. 5.
Figure 8:
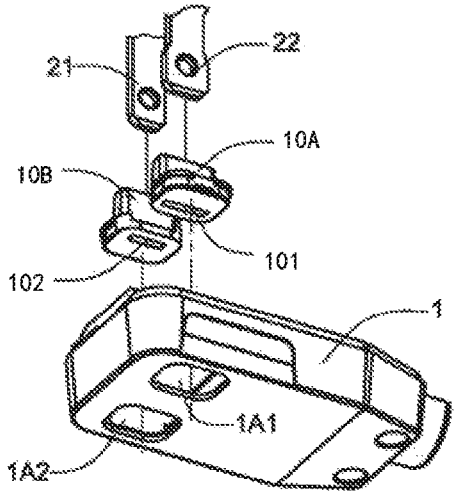
FIG. 8 is an exploded view of a portion of the power plug of FIG. 7, viewed from the bottom.

FIGS. 7 and 8 illustrate a power plug with leakage current protection device according to another embodiment. In this embodiment, the insertion plate sleeve similarly includes a number of parts corresponding to the number of input insertion plates 21, 22; a difference between this embodiment and the first embodiment is that here the two pats 101 and 103 are separate parts which form two individual and separate insertion plate sleeves 10A, 10B. The insertion plate sleeve 10A includes an assembly base 103A formed around the bottom of the part 101 and a hole 105 for accommodating the input insertion plate 22 that passes through it. Likewise, the insertion plate sleeve 10B includes an assembly base 103B formed around the bottom of the part 102 and a hole 104 for accommodating the input insertion plate 21 that passes through it. Correspondingly, the base 1 has two openings 1A1, 1A2 which respectively cooperate with and connect with the insertion plate sleeves 10A, 10B, for example via hooks and snaps.

It should be understood that the embodiments illustrated in FIGS. 1-8 only show and label the main components of constituent parts of the power plug of the present invention. The shape and arrangements of the components and parts are illustrative only and not limiting. The power plug may employ components and parts having other shapes and sizes without departing from the spirit of the invention. Further, the insertion plate sleeves of the various embodiments can be made of suitable insulating and temperature resistant materials which may be selected based on the temperature environments of the power plug. The suitable materials be, without limitation, engineering plastics, ceramics, fiber glass, etc.

The power plug with leakage current projection device according to embodiments of the present invention has a simple overall structure, and can be reliably assembled. It can effectively prevent safety risk caused by high temperature of the insertion plates, without increasing the assembled size of the power plug. It also has low cost, and can be suitably employed in various types of power plugs.

It will be apparent to those skilled in the art that various modification and variations can be made in the power plug of the present invention without departing from the spirit or scope of the invention. Thus, it is intended that the present invention cover modifications and variations that come within the scope of the appended claims and their equivalents.

What is claimed is:

1. A power plug with leakage current protection device, comprising:

a body formed of an upper cover and a base;

a core assembly disposed in the body;

a cable assembly attached to the body;

a plurality of input insertion plates;

a plurality of output moving contact arms;

wherein the plurality of input insertion plates and the plurality of output moving contact arms are assembled with the core assembly; and an insertion plate sleeve disposed on the base, the insertion plate sleeve including a plurality of tubular sleeves disposed separate from and in parallel to each other, each tubular sleeve disposed around one of the plurality of input insertion plates, wherein the input insertion plates pass through the tubular sleeves of the insertion plate sleeve to protrude from the base, and wherein the insertion plate sleeve is made of an insulating and temperature resistant material which is different from a material that the body is formed of, wherein the material of the insertion plate sleeve has higher temperature resistance than the material of the body.

2. The power plug of claim 1, wherein the insertion plate sleeve further includes an assembly base which is connected to the base of the body, and wherein the plurality of tubular sleeves are integrally connected to the assembly base.

3. The power plug of claim 1, wherein the insertion plate sleeve is formed integrally as one piece.

4. The power plug of claim 1, wherein the base of the body defines an opening, and wherein the insertion plate sleeve is disposed in the opening and the assembly base of the insertion plate sleeve is connected to the base of the body via snaps.

5. The power plug of claim 1, wherein the insertion plate sleeve is formed of engineering plastics, ceramics, or fiber glass.

6. The power plug of claim 1, further comprising a plurality of assembly bases, wherein each assembly base is connected to the base of the body and each tubular sleeve is integrally connected to a corresponding assembly base.

7. The power plug of claim 6, wherein the base of the body defines a number of openings corresponding to the number of the input insertion plates, and wherein each of the separate parts is disposed in a corresponding opening and the assembly base of the part is connected to the base of the body via snaps.

8. The power plug of claim 1, wherein the material of the insertion plate sleeve is free of heat-induced deformation and melting at a temperature of 110 degrees C., and the material of the body deforms or melts by heat at the temperature of 110 degrees C.

* * * * *